US006878247B2

(12) United States Patent
Duruz et al.

(10) Patent No.: US 6,878,247 B2
(45) Date of Patent: Apr. 12, 2005

(54) METAL-BASED ANODES FOR ALUMINIUM ELECTROWINNING CELLS

(75) Inventors: Jean-Jacques Duruz, Geneva (CH); Thinh T. Nguyen, Onex (CH); Vittorio De Nora, Nassau (BS)

(73) Assignee: Moltech Invent S.A., Luxembourg (LU)

( * ) Notice: Subject to any disclaimer, the term of this patent is extended or adjusted under 35 U.S.C. 154(b) by 331 days.

(21) Appl. No.: 10/161,036

(22) Filed: Jun. 3, 2002

(65) Prior Publication Data

US 2003/0066755 A1 Apr. 10, 2003

Related U.S. Application Data

(63) Continuation-in-part of application No. PCT/IB00/01812, filed on Dec. 6, 2000, and a continuation-in-part of application No. PCT/IB00/01481, filed on Oct. 16, 2000, and a continuation-in-part of application No. PCT/IB99/01976, filed on Dec. 9, 1999.

(51) Int. Cl.[7] ..... C25B 11/04

(52) U.S. Cl. ..... 204/293; 205/384; 205/385; 205/387; 205/394; 420/459; 423/150.1

(58) Field of Search ..... 204/293; 205/384, 205/385, 387, 394

(56) References Cited

U.S. PATENT DOCUMENTS

| | | | | | |
|---|---|---|---|---|---|
| 5,510,008 | A | * | 4/1996 | Sekhar et al. | 205/384 |
| 5,904,828 | A | * | 5/1999 | Sekhar et al. | 205/188 |
| 6,521,115 | B1 | * | 2/2003 | Duruz et al. | 205/387 |
| 6,562,224 | B1 | * | 5/2003 | Crottaz et al. | 205/384 |

* cited by examiner

*Primary Examiner*—Bruce F. Bell
(74) *Attorney, Agent, or Firm*—Jayadeep R. Deshmukh

(57) ABSTRACT

An anode of a cell for the electrowinning of aluminium comprises a nickel-iron alloy substrate having an openly porous nickel metal rich outer portion whose surface is electrochemically active. The outer portion is optionally covered with an external integral nickel-iron oxide containing surface layer which adheres to the nickel metal rich outer portion of the nickel-iron alloy and which in use is pervious to molten electrolyte. During use, the nickel metal rich outer portion contains cavities some or all of which are partly or completely filled with iron and nickel compounds, in particular oxides, fluorides and oxyfluorides.

52 Claims, No Drawings

METAL-BASED ANODES FOR ALUMINIUM ELECTROWINNING CELLS

This application is a continuation in part of PCT/IB00/01812 filed Dec. 6, 2000, and is a continuation in part of PCT/IB00/01481 filed Oct. 16, 2000, and is a PCT/IB99/01976 filed Dec. 9, 1999

FIELD OF THE INVENTION

This invention relates to non-carbon, metal-based, anodes for use in cells for the electrowinning of aluminium from alumina dissolved in a fluoride-containing molten electrolyte, methods for their fabrication, and electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old. This process, conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the cost of aluminium production.

U.S. Pat. No. 4,374,050 (Ray) discloses inert anodes made of specific multiple metal compounds which are produced by mixing powders of the metals or their compounds in given ratios followed by pressing and sintering, or alternatively by plasma spraying the powders onto an anode substrate. The possibility of obtaining the specific metal compounds from an alloy containing the metals is mentioned.

U.S. Pat. No. 4,614,569 (Duruz/Derivaz/Debely/Adorian) describes non-carbon anodes for aluminium electrowinning coated with a protective coating of cerium oxyfluoride, formed in-situ in the cell or pre-applied, this coating being maintained by the addition of a cerium compound to the molten cryolite electrolyte. This made it possible to have a protection of the surface from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer. Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective oxygen barrier layer. However, full protection of the alloy substrate was difficult to achieve.

U.S. Pat. No. 5,510,008 (Sekhar/Liu/Duruz) discloses an anode made from an inhomogeneous porous metallic body obtained by micropyretically reacting a metal powder mixture of nickel, iron, aluminium and optionally copper. The porous metal is anodically polarised in-situ to form a dense iron-rich oxide outer portion whose surface is electrochemically active. Bath materials such as cryolite which may penetrate the porous metallic body during formation of the oxide layer become sealed off from the electrolyte and from the active outer surface of the anode where electrolysis takes place, and remain inert inside the electrochemically-inactive inner metallic part of the anode.

PCT publication WO00/06803 (Duruz/de Nora/Crottaz) discloses an anode produced from a nickel-iron alloy which is surface oxidised to form a coherent and adherent outer iron oxide-based layer whose surface is electrochemically active surface. Oxidation is carried out in air for 5 to 100 hours at a temperature of 750° to 1150° C., in particular at 850°–950° C. for 24 hours or at 1150° C. for 72 hours, to grow the coherent outer oxide layer from the alloy and to a thickness from about 100 to 300 micron. This oxidation depletes the outer part of the alloy in iron metal and produces therein inclusions of iron oxide. The coherent and adherent outer iron oxide-based layer reduces the diffusion of oxygen and prevents electrolyte circulation to the alloy underneath so that oxidation of ions from the bath is confined on the electrochemically active surface of the oxide layer.

Metal or metal-based anodes are highly desirable in aluminium electrowinning cells instead of carbon-based anodes. Many attempts were made to use metallic anodes for aluminium production, however they were never adopted by the aluminium industry for commercial aluminium production because their lifetime must still be increased.

OBJECTS OF THE INVENTION

A major object of the invention is to provide an anode for aluminium electrowinning which has no carbon so as to eliminate carbon-generated pollution and has a long life.

A further object of the invention is to provide an aluminium electrowinning anode material with a surface having a high electrochemical activity for the oxidation of oxygen ions and the formation of bimolecular gaseous oxygen and a low solubility in the electrolyte.

Yet another object of the invention is to provide an improved anode for the electrowinning of aluminium which is made of readily available material(s).

Yet another object of the invention is to provide operating conditions for an aluminium electrowinning cell under which the contamination of the product aluminium is limited.

SUMMARY OF THE INVENTION

The invention relates to an anode of a cell for the electrowinning of aluminium from alumina dissolved in a fluoride-containing molten electrolyte. The anode comprises a nickel-iron alloy having an openly porous nickel rich outer portion which consists predominantly of nickel metal and whose surface constitutes an electrochemically-active anode surface of high active surface area, the openly porous nickel-rich outer portion being obtainable by removal of at least part of the iron from the nickel-iron alloy.

Cermet anodes which have been described in the past in relation to aluminium production have an oxide content which forms the major phase of the anode. Such anodes have an overall electrical conductivity which is higher than that of solid ceramic anodes but insufficient for industrial commercial production. Moreover, the uniformly distributed metallic phase is exposed to dissolution into the electrolyte.

Conversely, anodes predominantly made of metal and protected with a thick oxide outer layer (about 0.1 to 1 mm), e.g. as disclosed in U.S. Pat. No. 5,510,008 (Sekhar/Liu/Duruz) and WO00/06803 (Duruz/de Nora/Crottaz), have a higher conductivity and longer life because the metal is normally shielded from the bath and resists dissolution therein. However, in case such a thick oxide layer is damaged, molten electrolyte may penetrate into cracks between the metallic inner part and the oxide layer. The surfaces of the crack would then form a dipole between the metallic inner anode part and the oxide layer, causing electrolytic dissolution of the metallic inner part into the electrolyte contained in the crack and corrosion of the metallic anode part underneath the thick oxide layer.

The anode of the present invention provides a solution to this problem. Instead of being covered with a thick protective oxide layer, during use the metallic inner anode part contacts or virtually contacts circulating molten electrolyte. As opposed to prior art anodes, the electrolyte close to the openly porous anode portion, typically at a distance of less than 10 micron, is continuously replenished with dissolved alumina. The electrolysis current does not dissolve the anode. Instead the entire electrolysis current passed at the anode surface is used for the electrolysis of alumina by oxidising oxygen-containing ions directly on the active surfaces or by firstly oxidising fluorine-containing ions that subsequently react with oxygen-containing ions, as described in PCT/IB99/01976 (Duruz/de Nora).

Furthermore, the overall electrical conductivity of the metal anode according to the present invention is substantially higher than that of anodes covered with a thick oxide protective layer or made of bulk oxide.

In addition, the open porosity of the nickel-metal rich outer part provides an electrochemically active surface of high surface area. Hence, the anode can be operated with an apparent high electrolysis current while having a low effective current density at the anode's electrochemically active surface which makes it suitable for use in an electrolyte at reduced temperature containing a limited concentration of dissolved alumina.

The metal phase underlying the electrochemically active surface layer of the anode forms a matrix containing a minor amount of metal compound inclusions. Such inclusions can include oxides resulting from a pre-oxidation treatment in an oxidising atmosphere before use, or from oxidation during use, as well as fluorides and oxyfluorides resulting from use. This matrix confers an overall high electrical conductivity to the anode.

After an oxidation treatment before use, the inclusions may be iron-rich nickel-iron oxides, typically containing oxidised iron and oxidised nickel in an Fe/Ni atomic ratio above 2.

The nickel rich openly porous outer portion may contain pores, in particular round or elongated cavities in different configurations such as a vermicular configuration, which are partly or completely filled with iron and nickel compounds. The pores may have an average diameter of up to 5 micron and an average length of up to 30 micron.

The anode may be covered with two different types of oxide layers.

The first possible type of oxide layer is a thin integral oxide film, in particular having a thickness of less than 1 micron, which extends at the surface of the openly porous nickel-rich outer portion and along its pores and which underlies the electrochemically active anode surface.

The second possible type of oxide layer is a thicker integral nickel-iron containing oxide layer external but adhering to the openly porous outer portion and pervious to molten electrolyte, as mentioned above. The external integral oxide layer of the invention is usually thin, preferably having a thickness of less than 50 micron, in particular from 5 to 20 or even 30 micron.

Such an external integral oxide layer offers the advantage of limiting the width of possible pores and/or cracks present in the surface layer to a small size, usually below about a tenth of the thickness of the surface layer. When a small pore and/or crack is filled with molten electrolyte, the electrochemical potential difference in the molten electrolyte across the pore and/or crack is below the reduction-oxidation potential of any metal oxide of the surface layer present in the molten electrolyte contained in the pore and/or crack. Therefore, such a surface layer cannot be dissolved by electrolysis of its constituents within the pores and/or cracks.

On the other hand, the external integral oxide layer may be sufficiently electrically conductive to be electrochemically active and contribute to the oxidation of ions. Nevertheless, given the respective electrical resistivity of the external oxide layer and the electrolyte, it is believed that oxidation of ions predominantly takes place on the electrochemically active surface of the openly porous nickel-rich outer portion.

As mentioned above, the thinness of the external integral oxide layer permits circulation of electrolyte to the openly porous outer portion. When monoatomic oxygen evolved during electrolysis or resulting from dissolution in the electrolyte of biatomic molecular oxygen possibly reaches nickel metal instead of iron metal of the nickel metal rich outer portion, the nickel metal is oxidised to passive nickel oxide on the surface of the nickel metal rich outer portion. However, the presence of oxygen near the metal of the openly porous nickel-metal rich outer portion can be minimised by oxidising fluoride-containing ions instead of oxygen ions at the electrochemically active surface, as discussed in greater detail in the Examples and in PCT/IB99/01976 (Duruz/de Nora).

The external integral oxide layer usually comprises iron-rich nickel-iron oxide, such as nickel-ferrite, in particular non-stoichiometric nickel-ferrite. For instance, the external integral oxide layer may comprise nickel-ferrite having an excess of iron or nickel and/or an oxygen-deficiency.

The nickel-iron alloy may further comprise a non-porous oxide-free inner portion.

Before use, the anode can have an overall Ni/Fe atomic ratio below 1. Alternatively, it may be of at least 1, in particular from 1 to 4. For example, the inner portion of the anode may have a Ni/Fe atomic ratio below 1 and the outer portion of the anode may have a Ni/Fe atomic ratio from 1 to 4.

Usually the nickel rich openly porous outer portion has a decreasing concentration of iron metal towards its outermost part. This outermost part may comprise nickel metal and iron metal in an Ni/Fe atomic ratio of about 3 or more.

The nickel-iron alloy usually comprises nickel metal and iron metal in a total amount of at least 65 weight %, usually at least 80, 90 or 95 weight %, of the alloy, and further alloying metals in an amount of up to 35 weight %, in particular up to 5, 10 or 20 weight %, of the alloy. Minor amounts of further elements, such as carbon, boron, sulphur, phosphorus or nitrogen, may be present in the nickel-iron alloy, usually in a total amount which does not exceed 2 weight % of the alloy.

For example, the nickel-iron alloy can comprise at least one further metal selected from chromium, copper, cobalt, silicon, titanium, tantalum, tungsten, vanadium, zirconium, yttrium, molybdenum, manganese and niobium in a total amount of up to 5 or 10 weight % of the alloy. The nickel-iron alloy may also comprise at least one catalyst selected from iridium, palladium, platinum, rhodium, ruthenium, tin or zinc metals, Mischmetals and their oxides and metals of the Lanthanide series and their oxides as well as mixtures and compounds thereof, in a total amount of up to 5 weight % of the alloy. Furthermore, the nickel-iron alloy may comprise aluminium in an amount of up to 5, 10 or 20 weight % of the alloy. The aluminium may form an intermetallic compound with nickel which is known to be mechanically and chemically well resistant.

The anode of the invention may comprise a inner core made of an electronically conductive material, such as metals, alloys, intermetallics, cermets and conductive ceramics, which inner core is covered with the nickel-iron alloy. In particular, the inner core may comprise at least one metal selected from copper, chromium, nickel, cobalt, iron, aluminium, hafnium, molybdenum, niobium, silicon, tantalum, tungsten, vanadium, yttrium and zirconium, and combinations and compounds thereof. For instance, the core may consist of an alloy comprising 10 to 30 weight % of chromium, 55 to 90 weight % of at least one of nickel, cobalt and/or iron and up to 15 weight % of at least one of aluminium, hafnium, molybdenum, niobium, silicon, tantalum, tungsten, vanadium, yttrium and zirconium.

In one embodiment, the inner core is a non-porous nickel rich nickel-iron alloy, having a nickel/iron weight ratio that is close to or higher than the nickel/iron weight ratio of the openly porous nickel rich outer portion, for example from 1 to 4 or higher, in particular above 3. Thus, during use, little or no iron diffuses from the inner core.

Another aspect of the invention relates to a method of manufacturing an anode as described above. The method comprises forming the nickel-rich openly porous outer portion which consists predominantly of nickel metal by: providing a nickel-iron alloy having an outer portion and selectively removing at least part of the iron from the outer portion; or providing particles of a nickel-iron alloy precursor and agglomerating these particles into an alloy with an openly porous outer portion.

When the anode is produced from a nickel-iron alloy, at least part of the iron rather than nickel can be selectively removed therefrom by electrolytic dissolution to form the nickel-rich openly porous outer portion of the nickel-iron alloy.

Alternatively, at least part of the iron rather than nickel of the nickel-iron alloy may be selectively oxidised and diffused therefrom to form the openly porous outer portion of the nickel-iron alloy. An external integral nickel-iron oxide containing layer pervious to molten electrolyte is usually formed from the diffused oxide surface layer on the openly porous nickel metal rich outer portion. The oxidation of the nickel-iron alloy may comprise one or more steps at a temperature of 800° to 1200° C., in particular 1050° to 1150° C., for up to 60 hours in an oxidising atmosphere. Preferably, the nickel-iron alloy substrate is oxidised in an oxidising atmosphere for a short period of time, such as 0.5 to 5 or even 10 hours. The oxidising atmosphere may contain 10 to 100 molar % oxygen and the balance one or more inert gases, such as argon. Conveniently, the oxidising atmosphere can be air.

In order to obtain a microstructure of the nickel-iron alloy giving upon oxidation an optimal electrochemically active surface layer on an optimal nickel metal rich outer portion, the nickel-iron alloy may be subjected to a thermal-mechanical treatment for modifying its microstructure before oxidation. Alternatively, it may be cast, before oxidation, with known casting additives.

Furthermore, the oxidation of the nickel-iron alloy in an oxidising atmosphere may be followed by a heat treatment in an inert atmosphere at a temperature of 800° to 1200° C. for up to 60 hours. The selective removal of iron, in particular by oxidation in an oxidising atmosphere, can be carried out before use of the anode, then continued by iron dissolution in-situ at the beginning of electrolysis.

As mentioned above, the nickel-iron alloy layer may be formed on an inner core made of an electronically conductive material, such as a nickel-rich nickel-iron alloy inner core. Nickel and iron metal may be deposited as such onto the inner core, or compounds of nickel and iron may be deposited on the inner core and then reduced, for example one or more layers of $Fe(OH)_2$ and $Ni(OH)_2$ are deposited onto the core, e.g. as a colloidal slurry, and reduced in a hydrogen atmosphere to form an openly porous nickel-iron alloy layer. Nickel and iron and/or compounds thereof may be co-deposited onto the inner core or deposited separately in different layers which are then interdiffused, e.g. by heat treatment. This heat treatment may take place in an inert atmosphere such as argon, if the nickel and iron are applied as metals, or in a reducing atmosphere such as hydrogen, if nickel and iron compounds are applied onto the inner core. The nickel and iron metals and/or compounds may be deposited by electrolytic or chemical deposition, arc or plasma spraying, painting, dipping or spraying.

When the anode is manufactured by providing particles of a nickel-iron alloy precursor of the openly-porous outer portion, these particles may be agglomerated by reactive or non-reactive sintering.

A further aspect of the invention concerns a cell for the electrowinning of aluminium from alumina dissolved in a fluoride-containing molten electrolyte. The cell according to the invention comprises at least one anode as described above which faces and is spaced from at least one cathode.

The invention also relates to a method of producing aluminium in such a cell. The method comprises passing an ionic current in the molten electrolyte between the cathode (s) and the electrochemically active surface layer of the anode(s), thereby evolving at the anode(s) oxygen gas derived from the dissolved alumina and producing aluminium on the cathode(s).

At least part of the iron rather than nickel of the nickel-rich openly porous outer portion of the anode(s) may be selectively removed by electrolytic dissolution in-situ.

At the beginning of electrolysis, at least part of the iron rather than nickel of the nickel-rich openly porous outer portion of the anode(s) may be removed by oxidising the outer portion in-situ by atomic and/or molecular oxygen formed on the electrochemically active surface until the electrochemically active surface forms an impervious barrier to oxygen.

Advantageously, the method includes substantially saturating the molten electrolyte with alumina and species of at least one major metal, usually iron and/or nickel, present in the nickel-rich openly porous outer portion of the anode(s) to inhibit dissolution of the anode(s). The molten electrolyte may be operated at a temperature sufficiently low to limit the solubility of the major metal species thereby limiting the contamination of the product aluminium to an acceptable level.

A "major metal" refers to a metal which is present in the surface of the metal-based anode, in an amount of at least 25 atomic % of the total amount of metal present in the surface of the metal based anode.

The cell can be operated with the molten electrolyte at a temperature from 730° to 910° C., in particular below 870° C.

As disclosed in PCT/IB99/01976 (Duruz/de Nora), the electrolyte may contain $AlF_3$ in such a high concentration that fluorine-containing ions predominantly rather than oxygen ions are oxidised on the electrochemically active surfaces, however, only oxygen is evolved, the evolved oxygen being derived from the dissolved alumina present near the electrochemically active anode surfaces.

Preferably, aluminium is produced on an aluminium-wettable cathode, in particular on a drained cathode, for instance as disclosed in U.S. Pat. No. 5,683,559 (de Nora) or in PCT application WO099/02764 (de Nora/Duruz).

In a modification, the nickel of the nickel-iron alloy, in particular of the openly porous outer portion, is wholly or predominantly substituted by cobalt.

DETAILED DESCRIPTION

The invention will be further described in the following Examples:

EXAMPLE 1

Anode Preparation

An anode according to the invention was made by pre-oxidising in air at 1100° C. for 1 hour a substrate of a nickel-iron alloy consisting of 60 weight % nickel and 40 weight % iron, whereby an external integral oxide layer was formed on the alloy.

The surface-oxidised anode was cut perpendicularly to the anode operative surface and the resulting section of the anode was subjected to microscopic examination.

The anode before use had an openly porous nickel metal rich outer portion having a thickness of up to 10–15 micron. This outer portion was covered with the external integral oxide layer that was made of iron-rich nickel-iron oxide and had a thickness of up to 10–20 micron. The openly porous outer portion was made of an iron-depleted nickel-iron alloy containing generally round cavities filled with iron-rich nickel-iron oxide inclusions and having a diameter of about 2 to 5 micron. The nickel-iron alloy of the outer portion contained about 75 weight % nickel.

Underneath the openly porous outer portion, the nickel-iron alloy had remained substantially unchanged.

EXAMPLE 2

Electrolysis Testing

An anode prepared as in Example 1 was tested in an aluminium electrowinning cell containing a molten electrolyte at 870° C. consisting essentially of NaF and $AlF_3$ in a weight ratio $NaF/AlF_3$ of about 0.7 to 0.8, i.e. an excess of $AlF_3$ in addition to cryolite of about 26 to 30 weight % of the electrolyte, and approximately 3 weight % alumina. The alumina concentration was maintained at a substantially constant level throughout the test by adding alumina at a rate adjusted to compensate the cathodic aluminium reduction. The test was run at a current density of about 0.6 $A/cm^2$ which generally corresponds to a current density of less than about 0.06 $A/cm^2$ on the surface of the pores. The electrical potential of the anode remained substantially constant at 4.2 volts throughout the test.

During electrolysis aluminium was cathodically produced while fluorine and/or fluorine-containing ions, such as aluminium oxyfluoride ions, rather than oxygen ions were oxidised on the nickel-iron anodes. However, only oxygen was evolved which was derived from the dissolved alumina present near the anodes.

After 72 hours, electrolysis was interrupted and the anode was extracted from the cell. The external dimensions of the anode had remained unchanged during the test and the anode showed no signs of damage.

The anode was cut perpendicularly to the anode operative surface and the resulting section of the used anode was subjected to microscopic examination, as in Example 1.

It was observed that the anode had an electrochemically active surface covered with a discontinuous, non-adherent, macroporous iron oxide external layer of the order of 100 to 500 micron thick, hereinafter called the "excess iron oxide layer". The excess iron oxide layer was pervious to and contained molten electrolyte, indicating that it had been formed during electrolysis.

The excess iron oxide layer resulted from the excess of iron contained in the portion of the nickel-iron alloy underlying the electrochemically active surface and which diffuses therethrough. In other words, the excess iron oxide layer resulted from an iron migration from inside to outside the anode during the beginning of electrolysis.

Such an excess iron oxide layer has no or little electrochemical activity. It slowly diffuses and dissolves into the electrolyte until the portion of the anode underlying the electrochemically active surface reaches an iron content of about 15–20 weight % corresponding to an equilibrium under the operating conditions at which iron ceases to diffuse, and thereafter the iron oxide layer continues to dissolve into the electrolyte.

The anode's aforementioned openly porous outer portion had been transformed during electrolysis. Its thickness had grown from 10–20 micron to about 300 to 500 micron and the cavities had also grown in size to vermicular form but were only partly filled with iron and nickel compounds, in particular oxides and fluorides or oxyfluorides. No electrolyte was detected in the cavities and no sign of corrosion appeared throughout the anode.

Underneath the outer portion, the nickel-iron alloy had remained unchanged.

The shape and external dimensions of the anode had remained unchanged after electrolysis which demonstrated stability of this anode structure under the operating conditions in the molten electrolyte.

In another test a similar anode was operated under the same conditions for several hundred hours at a substantially constant current and cell voltage which demonstrated the long anode life compared to known non-carbon anodes.

EXAMPLE 3

Anode Preparation

Another anode according to the invention was prepared by coating a nickel-rich nickel-iron alloy substrate with a layer of nickel-iron alloy richer in iron, and heat treating this coated substrate. The alloy substrate consisted of 80 weight % nickel and 20 weight % iron. The alloy layer consisted of about 50 weight % nickel and 50 weight % iron.

The alloy layer was electrodeposited onto the alloy substrate using an appropriate electroplating bath prepared by dissolving the following constituents in deionised water at a temperature of about 50° C.:

| | | |
|---|---|---|
| a. | Nickel sulfate hydrate ($NiSO_4.7\ H_2O$): | 130 g/l |
| b. | Nickel chloride hydrate ($NiCl_2.\ 6\ H_2O$): | 90 g/l |
| c. | Ferrous sulfate hydrate ($FeSO_4.78\ H_2O$): | 52 g/l |
| d. | Boric acid $H_3BO_3$: | 49 g/l |
| e. | 5-Sulfo-salicylic acid hydrate ($C_7H_6O_6S.2\ H_2O$): | 5 g/l |
| f. | o-Benzoic acid sulfimide Sodium salt hydrate ($C_7H_4NaO_3S.aq$): | 3.5 g/l |
| g. | 1-Undecanesulfonic acid Sodium salt ($C_{11}H_{23}NaO_3S$): | 3.5 g/l |

To assist dissolution, the constituents were stirred in the deionised water.

The alloy layer was electrodeposited onto the cathodically polarised alloy substrate from a nickel-iron alloy anode consisting of 50 weight % nickel and 50 weight % iron, immersed in the electroplating bath at a temperature of 50 to 55° C. After 4 hours electrodeposition at a cathodic current density of 0.060 A/cm$^2$, the deposited layer had an average thickness of about 250 to 280 micron with an average composition of 47.5 weight % nickel and 52.5 weight % iron.

After deposition, the coated alloy substrate was surface oxidised at 1100° C. in air for 1 hour and cooled to room temperature. The surface-oxidised anode was then cut perpendicularly to the anode operative surface and the resulting section of the anode was subjected to microscopic examination as in Example 1.

It was observed that the external anode surface was covered with iron-rich nickel-iron oxides over a thickness of about 20 to 25 micron.

The alloy layer had an iron-depleted nickel-iron alloy openly porous outer portion with a thickness of about 50 micron, this outer portion containing generally round iron-rich nickel-iron oxide inclusions in a nickel-iron alloy containing about 70 to 75 weight % nickel metal. The inclusions had a diameter of about 2 to 5 micron. Underneath this outer part, the composition of the alloy layer had remained substantially unchanged.

Some minor interdiffusion of iron was also observed at the interface between the alloy layer and the alloy substrate enhancing the adherence of the layer on the substrate.

EXAMPLE 4

Electrolysis Testing

An anode prepared as in Example 3 was tested in an aluminium electrowinning cell as in Example 2 except that the electrolyte contained approximately 4 weight % alumina and that the anode was tested during 75 hours.

During electrolysis aluminium was produced and oxygen evolved. The anode when inspected showed no signs of having been subjected to the usual type of oxidation/passivation mechanisms observed with prior art process. This lead to the conclusion that predominantly fluorine and/or fluorine-containing ions, such as aluminium oxyfluoride ions, rather than oxygen ions were oxidised on the nickel-iron anodes. However, only oxygen was evolved which was derived from the dissolved alumina present near the anodes.

After electrolysis the anode was extracted from the cell and examined.

The external surfaces of the anode were crust free and its external dimensions were practically unchanged. No sign of damage was visible.

The anode was cut perpendicularly to the operative surface and the resulting section of the anode was subjected to the microscopic examination as in Example 1.

It was observed that the anode surface was covered with an iron rich oxide over a thickness of less than 25 to 50 micron. The thinness of this oxide layer attested the fact that the anode had not, or only marginally, been exposed to nascent monoatomic oxygen, hence that the oxidation process of fluorine-containing ions was predominant over the process of oxygen ions.

The anode's openly porous outer portion (depleted in iron metal) had grown from 50 to about 250 micron containing mainly empty pores. The pores were vermicular with a length limited to the thickness of the overall alloy layer and a diameter of about 10 micron. The openly porous outer portion was further depleted in iron metal and had a composition of about 75 weight % nickel and 25 weight % iron.

The structure and composition of the alloy substrate had remained substantially unchanged, with the exception of empty pores of random shape having a size of about 5 to 10 micron that were located at the substrate/layer interface and up to a depth of 100 to 150 micron. The empty pores resulted from the internal oxidation and diffusion towards the anode's surface of iron during electrolysis.

EXAMPLE 5

Anode Preparation

A metallic anode consisting of an alloy of 70 weight % nickel and 30 weight % iron was conditioned to be suitable for electrolysis according to the invention by anodic polarisation in an electrolytic cell. The electrolytic cell contained a molten electrolyte at 850° C. consisting essentially of NaF and $AlF_3$ in a weight ratio $NaF/AlF_3$ of about 0.7 to 0.8, i.e. an excess of $AlF_3$ in addition to cryolite of about 26 to 30 weight % of the electrolyte. The electrolyte contained no alumina other than that present as impurity in the added $AlF_3$ making about 2 weight % of the electrolyte.

Before immersion into the electrolyte, the anode was pre-heated for 0.5 hour over the cell to a temperature of about 750° C.

After immersion into the conditioning electrolyte, the anode was polarised at an initial current density of about 0.06–0.1 A/cm$^2$ which decreased over time to less than about 0.01 A/cm$^2$. The cell voltage was about 2.2 volt and the anode potential was below 2 volt. Thus, substantially no oxygen could be evolved during polarisation. The current passed during polarisation was essentially due to selective anodic dissolution of iron present at and close to the surface of the anode.

After 24 hours, polarisation was interrupted and the anode was extracted from the cell. The external dimensions of the anode had remained unchanged and was covered with black oxide.

This conditioned anode was ready to be used for the production of aluminium according to the invention. The anode's composition was ascertained by cutting it perpendicular to the operative surface and the resulting section of the anode was subjected to the microscopic examination, as in Example 1.

It was observed that the anode surface was covered with a very thin film of iron-rich oxide having a thickness of less than 1 micron. Underneath, the anode had an iron-depleted nickel-iron alloy openly porous outer portion which had an average thickness of 100 to 150 micron. This outer alloy portion had vermicular pores with a diameter of 10 to 30 micron that were empty except for small oxide inclusions.

The average metal composition of the openly porous outer portion was about 80 weight % nickel and 20 weight % iron. Below the openly porous outer portion, the initial nickel-iron alloy composition had remained substantially unchanged.

In a variation of this Example, the composition of the anode can be changed. For instance, the starting alloy contains 30 weight % nickel and 70 weight % iron or 80 weight % nickel and 20 weight % iron.

A coated substrate as described in Example 3 can also be conditioned to form an anode suitable for the production of aluminium according to the invention by dissolving part of the iron of the anode as described in Example 5.

All or part of the nickel content of the anodes of Examples 1, 3 and 5 can be replaced by cobalt.

EXAMPLE 6

Electrolysis Testing

An anode as prepared in Example 5 was used in an aluminium electrowinning cell containing a molten electrolyte as described in Example 4.

As in Example 4, during electrolysis aluminium was produced and oxygen evolved. The anode inspection also led to the conclusion that fluorine-containing ions predominantly rather than oxygen ions were oxidised on the anode surface.

After 75 hours, electrolysis was interrupted and the anode was extracted from the cell. The external surfaces of the anode were crust free and its external dimensions were practically unchanged. No sign of damage was visible.

The anode was cut perpendicularly to the operative surface and the resulting section of the anode was subjected to the microscopic examination as in Example 1.

It was observed that the anode surface was covered with a iron rich oxide over a thickness of less than 25 to 50 micron. The anode surface was covered by a very thin film of iron-rich oxide having a thickness of less than 100 micron, which indicated that the iron depletion during electrolysis was less than for a pre-oxidised anode as in Example 2.

The anode's openly porous outer portion had grown from 150 micron to about 500 to 750 micron and contained pores that were substantially empty in their majority. Below this openly porous outer portion, the alloy composition had remained unchanged.

EXAMPLE 7

Anode Construction and Electrolysis Testing

An anode having an active structure of 210 mm diameter was made of three concentric rings spaced from one another by gaps of 6 mm. The rings had a generally triangular cross-section with a base of about 19 mm and were connected to one another and to a central vertical current supply rod by six members extending radially from the vertical rod and equally spaced apart from one another around the vertical rod. The gaps were covered with chimneys for guiding the escape of anodically evolved gas to promote the circulation of electrolyte and enhance the dissolution of alumina in the electrolyte as disclosed in PCT publication WO00/40781 (de Nora).

The anode and the chimneys were made from cast nickel-iron alloy containing 50 weight % nickel and 50 weight % iron that was heat treated as in Example 1. The anode was then tested in a laboratory scale cell containing an electrolyte as described in Example 2 except that it contained approximately 4 weight % alumina.

During the test, a current of approximately 280 A was passed through the anode at an apparent current density of about 0.8 A/cm$^2$ on the apparent surface of the anode which generally corresponds to a current density of less than about 0.08 A/cm$^2$ on the surface of the columnar pores of the anode. The electrical potential of the anode remained substantially constant at approximately 4.2 volts throughout the test.

The electrolyte was periodically replenished with alumina to maintain the alumina content in the electrolyte close to saturation. Every 100 seconds an amount of about 5 g of fine alumina powder was fed to the electrolyte. The alumina feed was periodically adjusted to the alumina consumption based on the cathode efficiency, which was about 67%.

As in Examples 4 and 6, during electrolysis aluminium was produced and oxygen evolved. The anode inspection also led to the conclusion that fluorine-containing ions predominantly rather than oxygen ions were oxidised on the anode surface.

After more than 1000 hours, i.e. 42 days, electrolysis was interrupted and the anode was extracted from the cell and allowed to cool. The external dimensions of the anode had not been substantially modified during the test but the anode was covered with iron-rich oxide and bath. The anode showed no sign of damage.

The anode was cut perpendicularly to the anode operative surface and the resulting section of a ring of the active structure was subjected to microscopic examination, as in Example 1.

It was observed that the openly porous outer alloy portion had grown inside the anode ring to a depth of about 7 mm leaving only an inner portion of about 5 mm diameter unchanged, i.e. consisting of a non-porous alloy of 50 weight % nickel and 50 weight % iron. The openly porous outer portion of the anode had a concentration of nickel varying from 85 to 90 weight % at the anode surface to 70 to 75 weight % nickel close to the non-porous inner portion, the balance being iron. The iron depletion in the openly porous outer portion corresponded about to the accumulation of iron present as oxide on the surface of the anode, which indicated that the iron oxide had not substantially dissolved into the electrolyte during the test.

SUMMARY OF EXAMPLES

In summary, the analysis of the anodes tested in all the above Examples showed that, at equal anode current, the oxidation rate of nickel-alloy anodes was between about 20 and 100 times smaller than the oxidation rate under conventional conditions in which the oxidation of oxygen ions is the sole or the predominant mechanism occurring at the surface of the anode, so in the above described Examples the nickel-alloy anodes should last several thousand hours, whereas in a normal cryolite electrolyte the anodes last less than 50 hours.

It is believed that the greatly reduced oxidation of iron at the anode surface under the present electrolysis conditions can have two causes. The first possible cause of oxidation is exposure to nascent oxygen produced by the oxidation of oxygen ions at the anode surface which may marginally occur in parallel to the oxidation of fluorine-containing ions and which might represent less than 1% of the overall oxidation mechanism at the anode surface. The second cause of oxidation is exposure to dissolved molecular oxygen which is marginally present in the electrolyte at a theoretical pressure of about $10^{-10}$ atm under the test conditions.

If the surface of nickel-iron alloy anodes described above were exposed to a significant oxygen concentration in the electrolyte, the nickel of the anode would be rapidly oxidised into NiO which would passivate the anode and prevent electrolysis. The absence of such oxidation/passivation confirms that no or substantially no oxygen ions are oxidised at the surface of the nickel-alloy anodes.

In addition, the presence of sodium-free fluorides, such as nickel, iron and aluminium fluorides and oxyfluorides, was observed in the pores of the tested anodes. This indicates that not electrolyte but fluorine or fluorides from the active anode surface penetrated into these pores, and confirms that the mechanism of oxidation of fluorine-containing ions took place at the surface of the anodes.

What is claimed is:

1. An anode of a cell for the electrowinning of aluminium from alumina dissolved in a fluoride-containing molten electrolyte, said anode comprising a nickel-iron alloy having an openly porous nickel rich outer portion which consists predominantly of nickel metal and whose surface constitutes an electrochemically-active anode surface of high active surface area, the openly porous nickel-rich outer portion having a vermicular porosity obtainable by removal of at least part of the iron from the nickel-iron alloy.

2. The anode of claim 1, wherein the nickel rich openly porous outer portion contains pores which are partly or completely filled with iron and nickel compounds.

3. The anode of claim 2, wherein the pores have an average diameter of up to 5 micron and an average length of up to 30 micron.

4. The anode of claim 2, wherein the openly porous nickel-rich outer portion has a thin integral oxide film which underlies the electrochemically active anode surface.

5. The anode of claim 4, wherein said oxide film has a thickness of less than 1 micron.

6. The anode of claim 1, which is covered with a thick external integral nickel-iron containing oxide layer which adheres to the openly porous outer portion and which is pervious to molten electrolyte.

7. The anode of claim 6, wherein the external integral oxide layer has a thickness of less than 50 micron, in particular from 5 to 30 micron.

8. The anode of claim 6, wherein said external integral oxide layer comprises iron-rich nickel-iron oxide.

9. The anode of claim 8, wherein said external integral oxide layer comprises nickel-ferrite.

10. The anode of claim 9, wherein the nickel-ferrite of said external integral oxide surface layer contains non-stoichiometric nickel-ferrite having an excess of iron or nickel, and/or an oxygen deficiency.

11. The anode of claim 1, wherein the nickel-iron alloy comprises a non-porous inner portion.

12. The anode of claim 11, wherein the non-porous inner portion has a Ni/Fe atomic ratio below 1 before use.

13. The anode of claim 1, wherein the nickel-rich openly porous outer portion has a Ni/Fe atomic ratio of at least 1, in particular from 1 to 4, before use.

14. The anode of claim 1, wherein the nickel rich openly porous outer portion has a decreasing concentration of iron metal towards its outermost part.

15. The anode of claim 14, wherein the outermost part of the openly porous nickel rich outer portion comprises nickel metal and iron metal in an Ni/Fe atomic ratio of more than 3.

16. The anode of claim 1, wherein the nickel-iron alloy comprises nickel metal and iron metal in a total amount of at least 65 weight %, in particular at least 80 weight %, preferably at least 90 weight % of the alloy.

17. The anode of claim 16, wherein the nickel-iron alloy comprises at least one further metal selected from chromium, copper, cobalt, silicon, titanium, tantalum, tungsten, vanadium, zirconium, yttrium, molybdenum, manganese and niobium in a total amount of up to 10 weight % of the alloy.

18. The anode of claim 16, wherein the nickel-iron alloy comprises at least one catalyst selected from iridium, palladium, platinum, rhodium, ruthenium, tin or zinc metals, Mischmetals and their oxides and metals of the Lanthanide series and their oxides as well as mixtures and compounds thereof, in a total amount of up to 5 weight % of the alloy.

19. The anode of claim 16, wherein the nickel-iron alloy comprises aluminium in an amount less than 20 weight %, in particular less than 10 weight %, preferably from 1 to 5 or even 6 weight % of the alloy.

20. The anode of claim 1, comprising a core made of an electronically conductive material, such as metals, alloys, intermetallics, cermets and conductive ceramics, which is covered with the nickel-iron alloy.

21. The anode of claim 20, wherein the core is a non-porous nickel rich nickel-iron alloy.

22. A method of manufacturing an anode according to claim 1 for use in a cell for the electrowinning of aluminium, comprising forming the nickel-rich openly porous outer portion which consists predominantly of nickel metal by providing a nickel-iron alloy having an outer portion and selectively removing at least part of the iron from the outer portion.

23. The method of claim 22, wherein the nickel-rich openly porous outer portion is formed by selectively removing iron from a nickel iron alloy by electrolytic dissolution.

24. The method of claim 23, wherein the selective removal of iron, in particular by oxidation in the oxidising atmosphere, is carried out partly before use of the anode and is continued in-situ by iron dissolution at electrolysis start-up.

25. The method of claim 22, wherein the nickel-rich openly porous outer portion is formed by selectively oxidising and diffusing iron from a nickel-iron alloy.

26. The method of claim 25, wherein an external integral nickel-iron oxide containing layer pervious to molten electrolyte is formed from the diffused oxidised iron rather than nickel, the oxide surface layer adhering to the openly porous nickel rich outer portion, the oxidation of the nickel-iron alloy comprising one or more steps at a temperature of 800° to 1200° C. for up to 60 hours in an oxidising atmosphere.

27. The method of claim 26, wherein the oxidising atmosphere consists of oxygen or a mixture of oxygen and one or more inert gases having an oxygen content of at least 10 molar % of the mixture.

28. The method of claim 27, wherein oxidation in the oxidising atmosphere is followed by a heat treatment in an inert atmosphere at a temperature of 800° to 1200° C. for up to 60 hours.

29. The method of claim 26, wherein the oxidising atmosphere is air.

30. The method of claim 25, wherein the nickel-iron alloy is oxidised in an oxidising atmosphere for 0.5 to 10 hours.

31. The method of claim 25, comprising oxidising the nickel-iron alloy at a temperature of 1050° to 1150° C.

32. The method of claim 25, comprising subjecting the nickel-iron alloy to a thermal-mechanical treatment to modify its microstructure before oxidation.

33. The method of claim 25, comprising casting the nickel-iron alloy with additives to provide a microstructure for enhancing oxidation.

34. The method of claim 22, comprising forming a nickel-iron alloy layer on a core made of an electronically conductive material, such as a nickel-rich nickel-iron alloy.

35. The method of claim 34, comprising depositing nickel and iron metal on the core.

36. The method of claim 34, comprising depositing nickel and iron compounds on the core and then reducing the compounds.

37. The method of claim 36, wherein the nickel and iron compounds are $Fe(OH)_2$ and $Ni(OH)_2$ which are reduced in a hydrogen atmosphere to form an openly porous nickel-iron alloy layer.

38. The method of claim 34, comprising co-depositing nickel and iron and/or compounds thereof onto the core.

39. The method of claim 34, comprising depositing at least one layer of iron and/or an iron compound and at least one layer of nickel and/or a nickel compound onto the core, and then interdiffusing the layers.

40. The method of claim 34, comprising depositing electrolytically or chemically at least one of nickel, iron and compounds thereof onto the core.

41. The method of claim 34, comprising arc spraying or plasma spraying at least one of nickel, iron and compounds thereof onto the core.

42. The method of claim 34, comprising applying at least one of nickel, iron and compounds thereof by painting, dipping or spraying onto the core.

43. The method of claim 22, wherein the nickel-rich openly porous outer portion is formed by sintering a powder precursor.

44. The method of claim 22 modified in that the nickel of the nickel-iron alloy, in particular of the outer portion, is wholly or predominantly substituted by cobalt.

45. A cell for the electrowinning of aluminium from alumina dissolved in a fluoride-containing molten electrolyte, the cell comprising at least one anode as defined in claim 1 facing and spaced from at least one cathode.

46. A method of producing aluminium in a cell according to claim 45 containing alumina dissolved in a molten electrolyte, the method comprising passing an ionic current in the molten electrolyte between the cathode(s) and the electrochemically active surface layer of the anode(s), thereby evolving at the anode(s) oxygen gas derived from the dissolved alumina and producing aluminium on the cathode(s).

47. The method of claim 46, wherein at least part of the iron rather than nickel of the nickel-rich openly porous outer portion of at least one anode is selectively removed by electrolytic dissolution in-situ.

48. The method of claim 46, wherein at least part of the iron rather than nickel of the nickel-rich openly porous outer portion of at least one anode is selectively removed by oxidising said outer portion in-situ by atomic and/or molecular oxygen formed on the electrochemically active surface until the electrochemically active surface forms a barrier impervious to oxygen.

49. The method of claim 46, comprising permanently and uniformly substantially saturating the molten electrolyte with alumina and species of at least one major metal present in the nickel-rich openly porous outer portion of the anode (s) to inhibit dissolution of the anode(s).

50. The method of claim 49, wherein the cell is operated with the molten electrolyte at a temperature sufficiently low to limit the solubility of said major metal species thereby limiting the contamination of the product aluminium to an acceptable level.

51. The method of claim 46, wherein the cell is operated with the molten electrolyte at a temperature from 730° to 910° C.

52. The method of claim 46, wherein aluminium is produced on an aluminium-wettable cathode, in particular a drained cathode.

* * * * *